US008833590B2

(12) United States Patent
Ichimura et al.

(10) Patent No.: US 8,833,590 B2
(45) Date of Patent: Sep. 16, 2014

(54) METALLIC CONTAINER CLOSURE HAVING INTERNAL PRESSURE RELEASE FUNCTION

(75) Inventors: Katsuhito Ichimura, Hiratsuka (JP); Kouichi Tsuchiya, Hiratsuka (JP); Shinya Matsumoto, Hiratsuka (JP); Hisashi Nakajima, Hiratsuka (JP); Mitsuo Kumata, Hiratsuka (JP); Kiyohisa Kaito, Hiratsuka (JP)

(73) Assignee: Japan Crown Cork Co., Ltd., Tokyo (JP)

( * ) Notice: Subject to any disclaimer, the term of this patent is extended or adjusted under 35 U.S.C. 154(b) by 203 days.

(21) Appl. No.: 13/314,242

(22) Filed: Dec. 8, 2011

(65) Prior Publication Data

US 2012/0074093 A1 Mar. 29, 2012

Related U.S. Application Data

(63) Continuation of application No. 11/500,408, filed on Aug. 8, 2006, now Pat. No. 8,167,161.

(30) Foreign Application Priority Data

| | | |
|---|---|---|
| Aug. 9, 2005 | (JP) | 2005-231262 |
| Aug. 25, 2005 | (JP) | 2005-244160 |
| Oct. 4, 2005 | (JP) | 2005-291418 |
| Mar. 7, 2006 | (JP) | 2006-061404 |

(51) Int. Cl.

| | |
|---|---|
| ***B65D 51/16*** | (2006.01) |
| ***B65D 41/04*** | (2006.01) |
| *B65D 41/34* | (2006.01) |

(52) U.S. Cl.

CPC ..... *B65D 41/348* (2013.01); *B65D 41/045* (2013.01); *B65D 51/1638* (2013.01)

USPC ..... 220/303; 215/307; 215/323; 215/327; 215/349; 220/367.1; 220/310.1

(58) Field of Classification Search

USPC ..... 220/303, 316, 367.1, 360, 310.1; 215/307, 323, 337, 349, 327

See application file for complete search history.

(56) References Cited

U.S. PATENT DOCUMENTS

| | | | |
|---|---|---|---|
| 1,137,725 | A | 4/1915 | Carvalho |
| 1,680,763 | A | 8/1928 | Carvalho |
| 1,881,529 | A | 10/1932 | Hammer |
| 3,083,854 | A | 4/1963 | Lusher |
| 3,455,479 | A | 7/1969 | Hadley et al. |
| 3,713,545 | A | 1/1973 | Lawrence et al. |

(Continued)

FOREIGN PATENT DOCUMENTS

| | | | |
|---|---|---|---|
| JP | 2003-155052 | A | 5/2003 |
| JP | 2004-175388 | A | 6/2004 |

(Continued)

*Primary Examiner* — Mickey Yu
*Assistant Examiner* — Niki Eloshway
(74) *Attorney, Agent, or Firm* — Sughrue Mion, PLLC

(57) ABSTRACT

A metallic container closure including a shell of a thin metal sheet having a circular top panel wall (7) and a skirt wall (9), and a synthetic resin liner arranged in the shell, the skirt wall (9) having a thread-forming region and an annular groove (17) positioned at an upper end portion of the thread-forming region, wherein an internal pressure release line A extending in the circumferential direction is arranged in the skirt wall (9) at a portion over the annular groove (17), and annular bead (30) is arranged so as to pass through between the internal pressure release line A and the annular groove (17).

19 Claims, 12 Drawing Sheets

(56) References Cited

U.S. PATENT DOCUMENTS

| | | | |
|---|---|---|---|
| 3,966,071 | A | 6/1976 | Northup |
| 4,007,851 | A | 2/1977 | Walker |
| 4,392,579 | A | 7/1983 | Uhlig et al. |
| 4,466,548 | A | 8/1984 | Herbert |
| 6,202,871 | B1 | 3/2001 | Kelly |
| 7,581,651 | B2 | 9/2009 | Matukawa et al. |
| 2005/0051559 | A1 | 3/2005 | Yamashita |

FOREIGN PATENT DOCUMENTS

| | | | |
|---|---|---|---|
| JP | 2004-262458 | A | 9/2004 |
| JP | 2004-269016 | A | 9/2004 |
| JP | 2004-331190 | A | 11/2004 |
| JP | 2004-359289 | A | 12/2004 |
| JP | 2005-014917 | A | 1/2005 |
| JP | 2006-103701 | A | 4/2006 |

METALLIC CONTAINER CLOSURE HAVING INTERNAL PRESSURE RELEASE FUNCTION

CROSS-REFERENCE TO RELATED APPLICATIONS

This application is a Rule 53(b) Continuation of U.S. patent application Ser. No. 11/500,408 filed Aug. 8, 2006, which claims benefit to Japanese Patent Application No. 2005-231262 filed Aug. 9, 2005, Japanese Patent Application No. 2005-244160 filed Aug. 25, 2005, Japanese Patent Application No. 2005-291418 filed Oct. 4, 2005 and Japanese Patent Application No. 2006-61404 filed Mar. 7, 2006. The above-noted applications are incorporated herein by reference in their entirety.

BACKGROUND OF THE INVENTION

1. Field of the Invention

The present invention relates to a metallic container closure having an internal pressure release function, i.e., having a function for automatically releasing the pressure in the container when the pressure in the container is elevated excessively.

2. Description of the Related Art

Usually, a carbonated beverage or the like beverage is filled in a container, and a container closure is mounted on the mouth-and-neck portion of the container to seal the mouth-and-neck portion. When the content in the container is heated to an excess degree in this state, however, the pressure in the container may elevate excessively. The container closure may, further, be once removed from the mouth-and-neck portion of the container and may be mounted again on the mouth-and-neck portion of the container to seal the mouth-and-neck portion. The content in the container, however, may often be rotten and fermented. In this case, too, the pressure in the container may elevate to an excess degree.

When the pressure in the container is elevated as described above, the container closure may jump off the mouth-and-neck portion of the container or, depending upon the cases, the container itself may be broken. To prevent such an inconvenience caused by an increase in the pressure in the container, a metallic container closure having an internal pressure release function has been proposed. As the metallic container closure, there has been known the one in which an internal pressure release line comprising a plurality of slits in the circumferential direction and a breakable narrow bridging portions formed among the slits, are formed at an upper end portion of a cylindrical skirt wall that hangs down from the circumferential edge of a circular top panel wall (see, for example, patent document 1).

With the container closure of the patent document 1, when the pressure in the container is elevated, the bridging portions break, the plurality of slits in the circumferential direction become continuous to form a large slit, the gas in the container is released to the exterior through this portion and, depending upon the cases, the top panel wall is, at the same time, deformed like a dome to release the gas in the container to thereby avoid inconvenience caused by an elevated internal pressure.

patent document 1: Japanese Utility Model Publication No. 7-25318)

In the above conventional internal pressure releasing metallic container closure, slits directed in the circumferential direction are provided in the upper portion of the skirt wall of a shell of a thin metal sheet, and the internal pressure release line is formed by the slits involving a problem in that deformation takes place from the slits that form the internal pressure release line at the time when the container closure is mounted on the mount-and-neck portion of the container and is wrap-seamed therewith. That is, the container closure is wrap-seamed with the mouth-and-neck portion of the container by putting the shell of a thin metal sheet on the mouth-and-neck portion of the container, pushing the skirt wall of the shell onto the mouth-and-neck portion of the container by using a suitable jig, and transferring the shape of the outer surface (e.g., threaded shape) of the mouth-and-neck portion of the container onto the skirt wall. When the jig is being pushed, however, the skirt wall of the lower portions of the slits is subject to be deformed.

In the conventional internal pressure releasing metallic container closure, further, when the pressure in the container is suddenly and sharply elevated, the bridging portions linking the slits in the circumferential direction are broken over the whole circumference, and an upper portion of the container closure inclusive of the top panel wall is separated away from the skirt wall and jumps out.

Besides, when the shell is made of a thin metal sheet having a tensile strength of about 195 N/mm$^2$, the conventional internal pressure releasing metallic container closure has been so designed that the bridging portions among the slits are broken when the pressure in the container is elevated to release the internal pressure. When the shell is made of a thin metal sheet having a high tensile strength, such as a thin plate of an aluminum base alloy having a tensile strength of 200 to 230 N/mm$^2$, the resistance against drop impact is improved but the bridging portions among the slits are not broken despite the pressure in the container is elevated and the internal pressure is not released. Therefore, the pressure in the container increases to an excess degree still causing such inconveniences that the top panel wall of the container closure jumps out or the container is broken.

SUMMARY OF THE INVENTION

It is therefore an object of the present invention to provide a metallic container closure having slits that constitute an internal pressure release line formed in an upper part of a skirt wall, effectively preventing the skirt wall from being deformed at a portion where the strength is decreasing due to the slits at the time of wrap-seaming with the mouth-and-neck portion of the container.

Another object of the present invention is to provide a metallic container closure which is capable of effectively releasing a gas in the container while reliably preventing such an inconvenience that the upper'portion inclusive of the top panel wall of the metallic container closure is separated away from the skirt wall and jumps out when the pressure is suddenly elevated in the container, and reliably prevents the container closure from jumping out or prevents the container from being broken when the pressure in the container is elevated.

A further object of the present invention is to provide a metallic container closure which is capable of reliably preventing the top panel wall from jumping out or preventing the container from being broken despite the pressure in the container is elevated even when the container closure is made of a thin metal sheet having a large strength.

According to the present invention, there is provided a metallic container closure comprising a shell of a thin metal sheet having a circular top panel wall and a cylindrical skirt wall hanging down from the circumferential edge of the top panel wall, and a synthetic resin liner arranged in the shell, the skirt wall of the shell having a thread-forming region and an annular groove positioned at an upper end portion of the thread-forming region, wherein:

an internal pressure release line inclusive of a slit extending in the circumferential direction is arranged in the skirt wall at a portion over the annular groove, and annular bead is arranged so as to pass through between the internal pressure release line and the annular groove.

In the metallic container closure of the present invention, it is desired that the internal pressure release line:

(1) is constituted by a plurality of slits arranged in the circumferential direction maintaining a distance, and low-strength bridging portions present among the slits and having a small width in the circumferential direction so as to be broken by an elevated pressure in the container; or (2) is formed by one long slit extending in the circumferential direction.

Further, the metallic container closure of the present invention may preferably employ the following embodiments.

(3) An internal pressure release assist line is formed on an extension in the circumferential direction of the internal pressure release line, the internal pressure release assist line being constituted by a plurality of slits extending in the circumferential direction and high-strength bridging portions which is positioned among the slits and has a width in the circumferential direction larger than that of the low-strength bridging portions.

(4) In addition to the internal pressure release assist line, a fixing line comprising ultra-high-strength bridging portions having a width in the circumferential direction larger than that of the high-strength bridging portions is formed on an extension of the internal pressure release line.

(5) The fixing line is positioned on the opposite side of the internal pressure release line in the direction of diameter.

(6) A reinforcing line comprising reinforcing bridging portions having a width larger in the circumferential direction than that of the high-strength bridging portions but is shorter in the circumferential direction than that of the ultra-high-strength bridging portions, is formed between the internal pressure release line and the internal pressure release assist line.

(7) The plurality of slits forming the internal pressure release line and the internal pressure release assist line all have substantially the same width in the circumferential direction.

(8) The internal pressure release line is constituted by long slits having a length 5 to 35% of the circumferential length of the skirt wall.

(9) The internal pressure release line includes slits having a short circumferential length in addition to the long slits.

(10) At least one weakened line extending in the axial direction is formed in a region where the internal pressure release line is formed.

(11) The weakened line is extending being continuous to the slits forming the internal pressure release line or from near the slits.

(12) The weakened line is positioned over the slits.

(13) The weakened line is a score.

(14) The weakened line is formed in a portion either at an end of the internal pressure release line in the circumferential direction or at an intermediate portion thereof in the circumferential direction.

(15) A pair of weakened lines extending aslant with respect to the axial direction are formed at both ends of the internal pressure release line in the circumferential direction, the pair of weakened lines extending in a direction in which they approach each other or separate away from each other from the lower side toward the upper side at slanting angles θ in a range of 10 to 45 degrees with respect to the axial direction.

(16) The pair of weakened lines are extending in a direction in which they approach each other from the lower side toward the upper side.

(17) The pair of weakened lines are extending upward in the axial direction being continuous to the slits or from near the slits.

(18) The internal pressure release line is formed over an angular range of 40 to 95 degrees.

(19) The low-strength bridging portion in the internal pressure release line has a width of 0.5 to 0.9 mm in the circumferential direction, and the slit in the internal pressure release line has a length of 2.5 to 4.0 mm in the circumferential direction.

(20) The internal pressure release line includes 4 to 6 low-strength bridging portions.

According to the present invention, further, there is provided a metallic container closure comprising a metallic shell having a circular top panel wall made of a thin metal sheet having a tensile strength of 200 to 230 N/mm$^2$ and a cylindrical skirt wall hanging down froth the circumferential edge of the top panel wall, and a synthetic resin liner arranged in the shell, the skirt wall of the shell having a thread-forming region and an annular groove positioned at an upper end portion of the thread-forming region, wherein:

an internal pressure release line extending in the circumferential direction at an angle of 40 to 95 degrees is arranged in the skirt wall at a portion over the annular groove, the internal pressure release line being constituted by a plurality of slits arranged in a circumferential direction maintaining a distance and low-strength bridging portions present among the slits and having a small width in the circumferential direction so as to be broken by an elevated pressure in the container.

The metallic container closure formed by using a thin metal sheet of a high tensile strength may preferably employ the following embodiments.

(21) The low-strength bridging portion in the internal pressure release line has a width of 0.5 to 0.9 mm in the circumferential direction, and the slit in the internal pressure release line has a length of 2.5 to 4.0 mm in the circumferential direction.

(22) The internal pressure release line includes 4 to 6 low-strength bridging portions.

(23) A fixing line is formed over an angle of 25 to 180 degrees in the portion on the opposite side of the internal pressure release line in the direction of diameter on an extension thereof, the reinforcing lines are formed over an angle of 10 to 55 degrees neighboring both ends of the internal pressure release line in the circumferential direction, the internal pressure release assist line is formed between the reinforcing line and the fixing line, the internal pressure release assist line being constituted by a plurality of slits extending in the circumferential direction and high-strength bridging portions positioned among the slits and having a width in the circumferential direction larger than that of the low-strength bridging portions, the fixing line being constituted by ultra-high-strength bridging portions having a width in the circumferential direction larger than that of the high-strength bridging portions, and the reinforcing line being constituted by reinforcing bridging portions having a width larger in the circumferential direction than that of the high-strength bridging portions but is shorter in the circumferential direction than that of the ultra-high-strength bridging portions.

(24) The fixing line is formed over an angle of 25 to 180 degrees in the portion on the opposite side of the internal pressure release line in the direction of diameter on an extension thereof, and the internal pressure release assist line is formed between the internal pressure release line and the fixing line, the internal pressure release assist line being constituted by a plurality of slits extending in the circumferential direction and high-strength bridging portions positioned among the slits and having a width larger in the circumferential direction than that of the low-strength bridging portions, and the fixing line being constituted by the ultra-high-strength bridging portions having a width larger in the circumferential direction than that of the high-strength bridging portions.

According to the present invention, there is further provided a metallic container closure comprising a shell of a thin metal sheet having a circular top panel wall and a cylindrical skirt wall hanging down from the circumferential edge of the top panel wall, and a synthetic resin liner arranged in the shell, the skirt wall of the shell having a thread-forming region and an annular groove positioned at an upper end portion of the thread-forming region, wherein:

an internal pressure release line inclusive of a slit extending in the circumferential direction is arranged in the skirt wall at a portion over the annular groove, and at least one weakened line extending in a axial direction or extending aslant with respect to the axial direction is formed in the region where the internal pressure release line is formed.

In the metallic container closure of the invention, it is desired that:

(25) the weakened lines are provided at both end portions of the internal pressure release line in the circumferential direction, the pair of weakened lines extending aslant in a direction in which they approach each other or separate away from each other from the lower side toward the upper side at slanting angles θ in a range of 10 to 45 degrees with respect to the axial direction.

In the container closure of the present invention, the internal pressure release line constituted by a slit is formed in the skirt wall to release the internal pressure sufficiently reliably when the pressure is excessively elevated in the container. Further, the annular bead is arranged in the skirt wall so as to pass through between the internal pressure release line and the annular groove making it possible to effectively prevent the skirt wall from being deformed at a portion where the internal pressure release line is formed at the time when the container closure is being wrap-seamed with the mouth-and-neck portion of the container.

In the container closure of the present invention, further, when the weakened line extending in the axial direction is formed in the region where the internal pressure release line is formed [embodiments (10) to (14) described above], the skirt wall easily and quickly deforms so as to expand outward with the weakened line as a fulcrum when the pressure in the container is suddenly elevated. As a result, the internal pressure release line is greatly opened to form a large opening, and the gas is released. That is, a large opening for releasing the gas is formed in only the region where the internal pressure release line is formed reliably preventing such an inconvenience that the upper portion of the container closure inclusive of the top panel wall is separated away from the skirt wall and jumps out. Further, the gas in the container can be reliably released.

In particular, when the pair of weakened lines extending aslant at predetermined angles (10 to 45 degrees) with respect to the axial direction are provided at both ends in the circumferential direction of the internal pressure release line [embodiments (16) and (17) described above], a very great advantage is obtained preventing such an inconvenience that part of the container closure inclusive of the top panel wall is separated away from the skirt wall and jumps out as compared to when the weakened line is extending in the vertical direction (axial direction).

That is, when the pressure in the container is abnormally elevated, the pair of weakened lines extending in the vertical direction (i.e., in parallel with the axial direction) may often break so as to spread along the circumferential edge of the top panel wall (boundary portion between the skirt wall and the top panel wall) starting from the upper end thereof. In particular, when the internal pressure release assist line in which the plurality of slits are extending in the circumferential direction via the bridging portions, is provided in a portion of the skirt wall other than the internal pressure release line, the weakened line may often break progressively up to the bridging portions among the slits of the internal pressure release assist line. As a result of the breakage of the weakened line, part of the container closure inclusive of the top panel wall may often be separated away from the skirt wall and may jump out (hereinafter often called top panel jumping).

When the pair of weakened lines are extending aslant with respect to the axial direction at a predetermined slanting angle θ, however, it is made possible to effectively avoid such an inconvenience that the weakened lines break beyond the internal pressure release line and, hence, to reliably avoid the problem of top panel jumping.

Though the reason has not yet been clarified why provision of the weakened lines aslant with respect to the axial direction increases the effect for suppressing the top panel jumping, the present inventors presume in a manner as described below. That is, when the pair of weakened lines extend aslant in a direction in which they approach each other from the lower side toward the upper side, the breakage thereof is less likely to spread to the internal pressure release assist line than when the weakened lines are extending in the vertical direction (i.e., in parallel with the axial direction), which is convenient for preventing the top panel jumping. Further, when the pair of weakened lines are extending in a direction in which they separate away from each other from the lower side toward the upper side, it is presumed that the breakage occurs most easily and quickly proceeds releasing the inner pressure in an early time and, as a result, the cap becomes little likely to jump.

It is important that the slanting angle θ of the weakened lines is in a range of 10 to 45 degrees. When this angle is smaller than 10 degrees, there is no much difference from when the weakened lines are formed in the vertical direction (i.e., in parallel with the axial direction) easily arousing a problem of top panel jumping. When the slanting angle θ is not smaller than 45 degrees, on the other hand, the weakened lines are not easily broken making it difficult to release the gas despite of an abnormal increase in the pressure in the container. That is, even when the pressure in the container is abnormally elevated, the weakened lines are not easily broken. Therefore, the pressure in the container is not released despite the bridging portions are broken among the slits in the circumferential direction. In this case, the pressure in the container increases to a conspicuous degree, the breakage proceeds over the whole circumference of the top panel wall of the container closure, and the top panel wall may jump off the mouth portion of the container (hereinafter often called top panel jumping). That is, in the present invention, the aslant weakened lines are formed at both ends of the internal pressure release region in a manner that the slanting angle θ is 10 to 45 degrees to reliably avoid the problem of top panel jumping. Further, the gas is effectively released when the pressure in the container is abnormally elevated avoiding the inconvenience of cap jumping.

Here, the pair of weakened lines may be so formed as to extend in a direction in which they approach each other from the lower side toward the upper side or, conversely, may be so formed as to extend in a direction in which they separate away from each other from the lower side toward the upper side. From the standpoint of reliably avoiding the above problem of top panel jumping, it is desired that the pair of weakened lines are extending in a direction in which they approach each other from the lower side toward the upper side. In this case, even if the breakage of the weakened lines spreads onto the extensions thereof, it is little likely that the breakage spreads to other regions (e.g., to the internal pressure release assist line) exceeding the internal pressure release line, which is convenient from the standpoint of preventing the top panel jumping.

Further, when the container closure is formed by using a thin metal sheet (e.g., thin aluminum base alloy sheet) having a tensile strength of 200 to 230 N/mm$^2$ according to the present invention, it is desired that the internal pressure release line constituted by the plurality of slits arranged in the circumferential direction maintaining a distance and the low-strength bridging portions among them, has a width in a range of 40 to 95 degrees in the circumferential direction. When the internal pressure release line is formed in this angular range, not only an excellent resistance against drop impact is exhibited but also a large opening is formed being limited in the internal pressure release line due to an elevated pressure in the container reliably preventing the inconveniences of top panel jumping and breakage of the container.

DETAILED DESCRIPTION OF THE INVENTION

Figure 1:
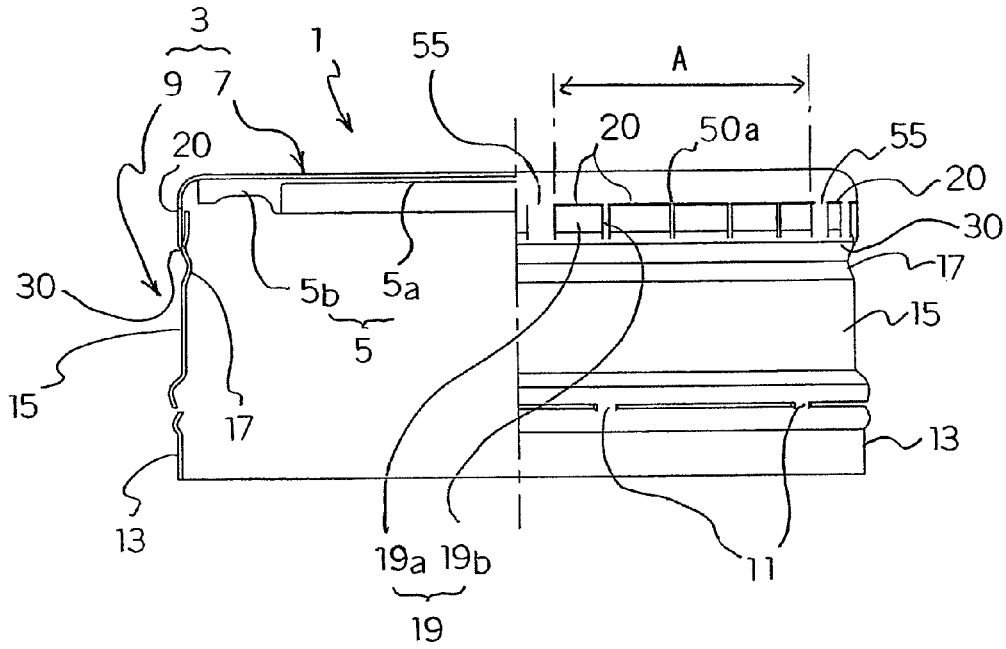
FIG. 1 is a half-sectional side view of a preferred example of a container closure of the present invention.

Referring to FIG. 1, the container closure of the invention generally designated at 1 is constituted by a shell 3 of a thin metal sheet and a synthetic resin liner 5.

There is no limitation on the material of the thin metal sheet forming the shell 3 so far as a suitable degree of strength is maintained, and there may be used a thin metal sheet such as of aluminum or an aluminum alloy. From the standpoint of maintaining a particularly excellent resistance against the drop impact, however, it is desired to use a thin aluminum base alloy sheet having a thickness of, for example, about 0.22 to about 0.26 mm and a tensile strength in a range of 200 to 230 N/mm$^2$. Further, the shell 3 has a circular top panel wall 7 and a skirt wall 9 of nearly a cylindrical shape hanging down from the circumferential edge of the top panel wall 7.

As will be clear from FIG. 1, the lower end of the skirt wall 9 is swollen outward in the radial direction, and a tamper-evidence (TE) hem portion 13 is continuing to the swollen lower end portion via a plurality of bridges 11 that can be broken.

Nearly central portion of the skirt wall 9 is serving as a thread-forming region 15 where a thread will be formed by the wrap-seaming that will be described later, and an annular groove 17 is formed in an upper end of the thread-forming region 15. The annular groove 17 is for introducing a jig used for the wrap-seaming.

A knurling 19 having recessed portions 19*a* and protruded portions 19*b* alternately arranged in the circumferential direction is formed over the annular groove 17, and a number of slits 20 extending in the circumferential direction maintaining a distance in the circumferential direction are formed at the upper ends of the recessed portions 19*a* (near the corners continuous to the circular top panel wall 7). A region such as an internal pressure release line A is formed by the slits 20. Usually, protruded portions 19*b* of the knurling 19 are positioned at the portions among the number of slits 20.

Figure 2:
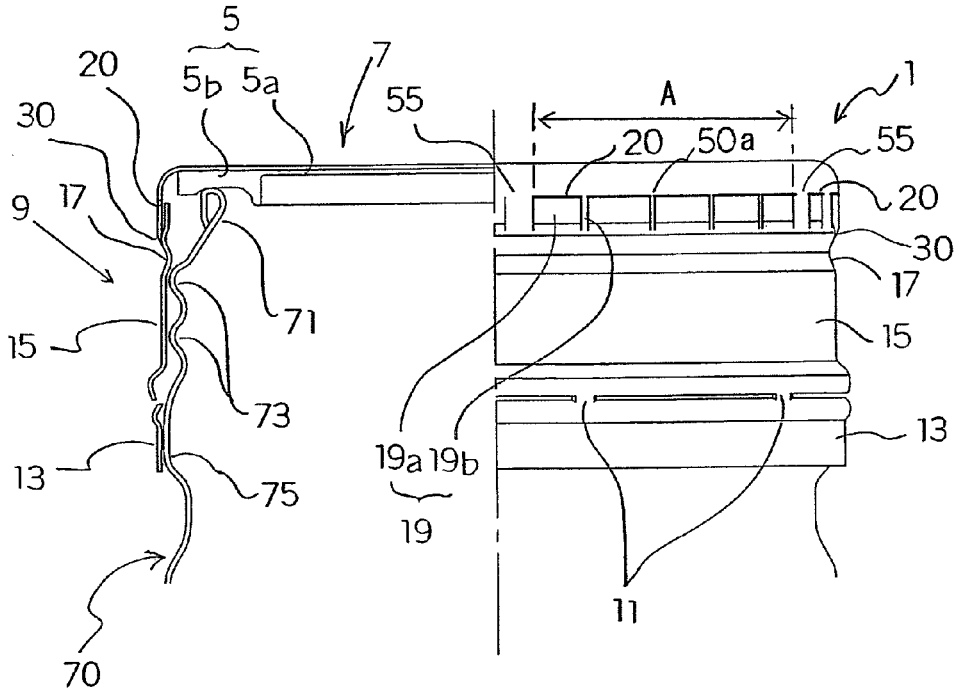
FIG. 2 is a half-sectional side view illustrating a state where the container closure of FIG. 1 is put on the mouth-and-neck portion of a container.
Figure 3:
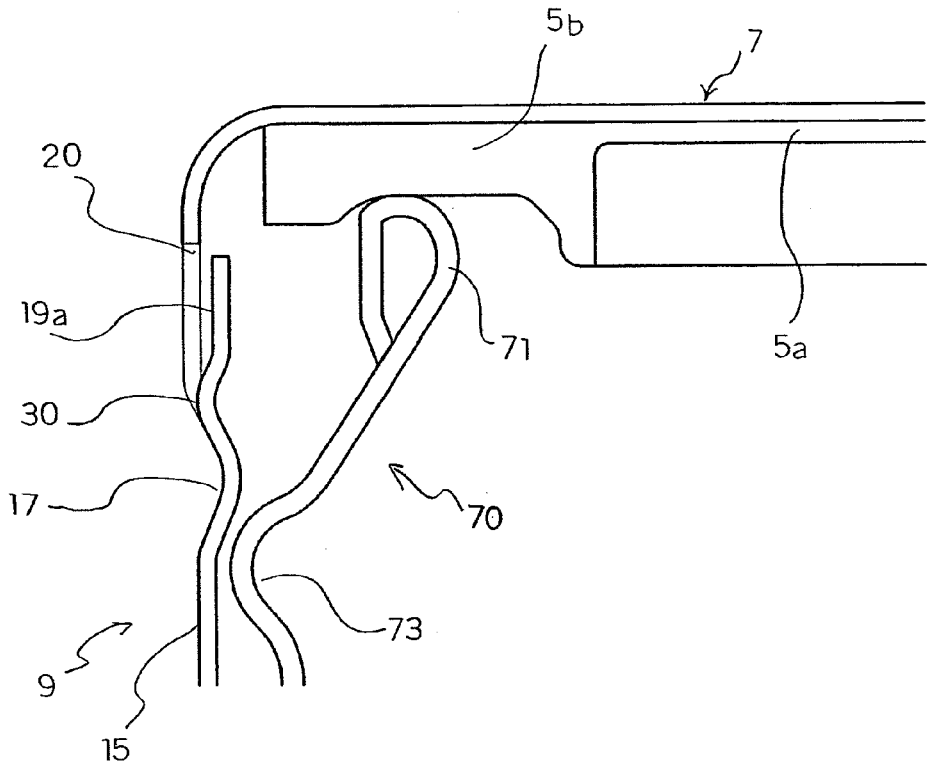
FIG. 3 is a sectional view illustrating, on an enlarged scale, a major portion of the container closure in the state of FIG. 2 together with the mouth-and-neck portion of the container.
Figure 4:
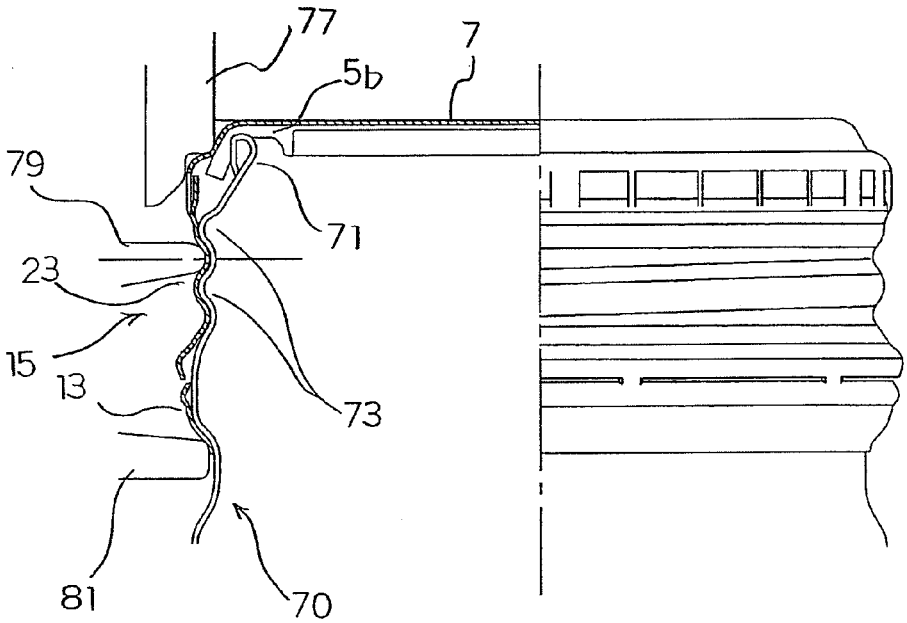
FIG. 4 is a view illustrating a step of wrap-seaming the container closure of FIG. 1 with the mouth-and-neck portion of the container.
Figure 5:
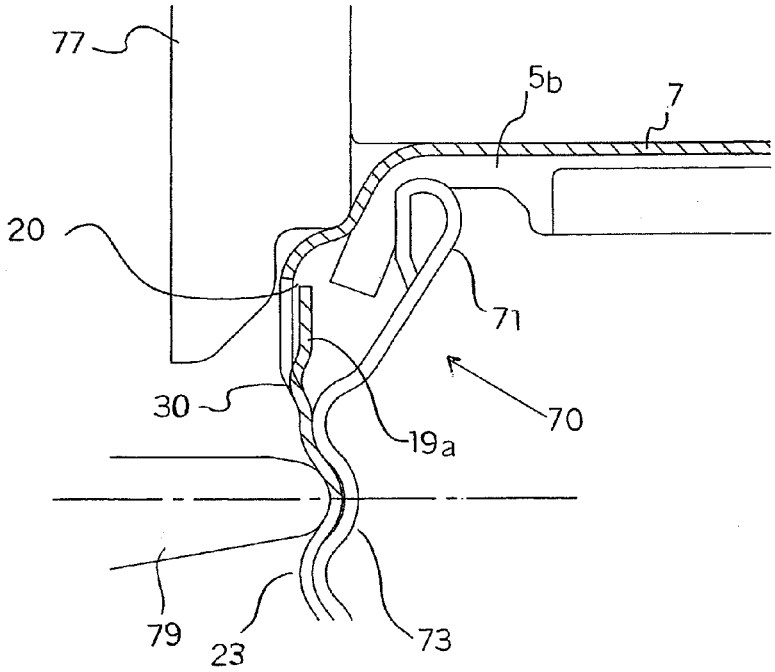
FIG. 5 is a view illustrating major portions of FIG. 4 on an enlarged scale.
Figure 6:
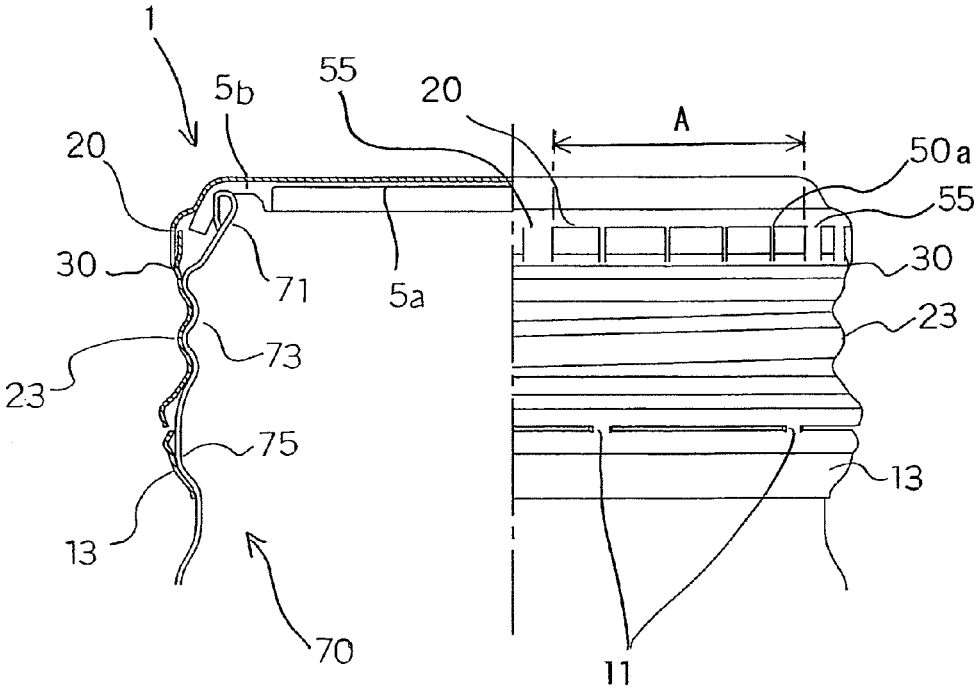
FIG. 6 is a half-cut side view illustrating a state where the container closure of FIG. 1 is wrap-seamed with the mouth-and-neck portion of the container.
Figure 7:
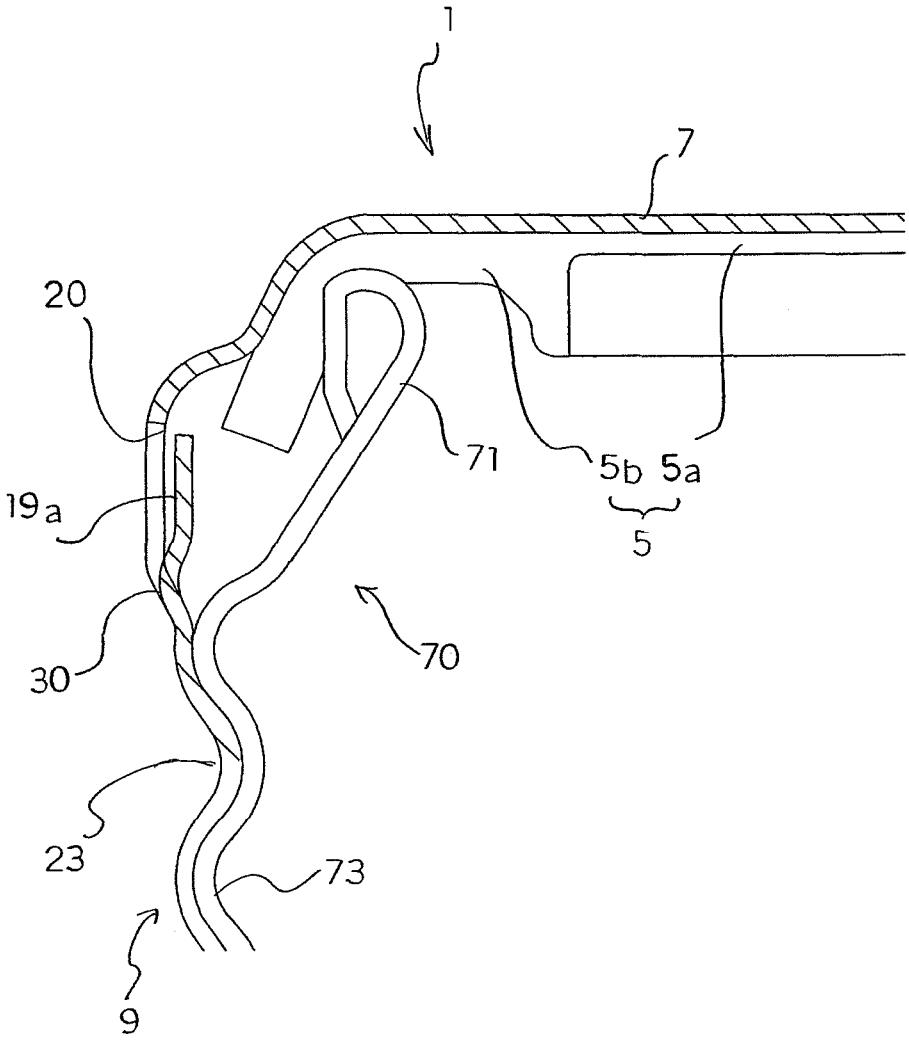
FIG. 7 is a sectional view illustrating, on an enlarged scale, major portions of the container closure in the state of FIG. 6.

If briefly described, the container closure 1 is put on the mouth-and-neck portion 70 of the container as shown in FIGS. 2 and 3, are wrap-seamed with the mouth-and-neck portion 70 of the container through wrap-seaming steps shown in FIGS. 4 and 5, and is fixed to the mouth-and-neck portion 70 of the container as shown in FIGS. 6 and 7 to thereby seal the mouth-and-neck portion 70 of the container.

Reverting to FIG. 1, the liner 5 is formed by using a suitable synthetic resin such as a soft polyethylene, and is desirably formed by feeding a molten synthetic resin onto the inner surface of the top panel wall 7 and press-forming the melt into a desired shape. The liner 5 in the illustrated embodiment is constituted by a relatively thin circular central portion 5*a* and a relatively thick annular circumferential edge portion 5*b*. As will be understood from FIG. 1, the central portion of the annular circumferential edge portion 5*b* is slightly recessed.

Referring to FIG. 2, the mouth-and-neck portion 70 of the container is made of a metal, a glass or a hard resin. FIG. 2 illustrates the one made of a metal. A curl portion 71 is formed at the upper end of the mouth-and-neck portion 70 of the container, a thread 73 is formed in the side surface thereof, and a jaw portion 75 is formed under the thread 73.

Referring to FIGS. 2 and 3 which are enlarged views illustrating major portions, in a state where the container closure 1 is put on the mouth-and-neck portion 70 of the container for being wrap-seamed with the mouth-and-neck portion 70 of the container, the recessed portion in the annular circumferential portion 5*b* of the liner 5 faces the upper end (curled portion 71) of the mouth-and-neck portion 70 of the container, and the lower end of the TE hem portion 13 of the container closure 1 is positioned under the jaw portion 75 of the neck-and-mouth portion 70 of the container.

In the above state, the wrap-seaming is effected as shown in FIGS. 4 and 5 which are enlarged views of major portions. Namely, the container closure 1 put on the mouth-and-neck portion 70 of the container is pushed onto the upper end of the mouth-and-neck portion 70 of the container by using an outer push fitting 77, a thread-forming roller 79 is introduced into the annular groove 17 in the container closure 1 while deforming the shoulder portion thereof and, thereafter, the roller 79 is turned along the thread 73 of the mouth-and-neck portion 70 of the container while pressing the skirt wall 9 of the container closure 1 to thereby form, in the thread-forming region 15 of the skirt wall 9, a thread 23 that screw-engages with the thread 73 of the mouth-and-neck portion 70 of the container. The lower end of the TE hem portion 13 of the container closure 1 is pressed onto the lower side of the jaw portion 75 of mouth-and-neck portion 70 of the container by a hem wrap-seaming roller 81, and is deformed along the lower side of the jaw portion 75.

Referring to FIGS. 6 and 7 which are enlarged views of major portions, through the above step of wrap-seaming, the container closure 1 is fixed by wrap-seaming to the mouth-and-neck portion 70 of the container, and the annular circumferential edge portion 5*b* of the liner 5 is intimately adhered to the upper end and the outer peripheral portion of the mouth-and-neck portion 70 (curling portion 71) of the container to seal the mouth-and-neck portion 70 of the container. In this state, the skirt wall 9 of the container closure 1 is screw-engaged with the outer surface of the mouth-and-neck portion 70 of the container, and the lower end of the TE hem portion 13 of the container closure 1 is fixed to the lower side of the jaw portion 75 of the mouth-and-neck portion 70 of the container.

As shown in FIGS. 6 and 7, when turned in a direction of opening the cap, the container closure 1 fixed by wrap-seaming to the mouth-and-neck portion 70 of the container has its skirt wall 9 lifted up and removed from the mouth-and-neck portion 70 of the container. Here, the TE hem portion 13 has its lower end engaged with the lower side of the jaw portion 75 of mouth-and-neck portion 70 of the container and is limited from being lifted up. As a result, the bridges 11 break and the TE hem portion 13 is cut away from the skirt wall 9. Therefore, the container closure 1 removed from the mouth-and-neck portion 70 of the container has the TE hem portion 13 that is separated, from which the fact of unsealing can be recognized. The knurling 19 works to prevent the slipping at the time of turning the container closure 1.

In the container closure 1 of the above constitution, the internal pressure release line A is formed by the slits 20 and low-strength bridging portions 50*a* of a short length among the slits 20 (see, for example, FIGS. 1 and 6). That is, when the pressure in the container is elevated due to some reason (e.g., fermentation of the content in the container), the top panel wall 7 of the container closure 1 will swell causing the low-strength bridging portions 50*a* among the slits 20 in the internal pressure release line A to be readily broken, and the gas is released. This effectively prevents such inconveniences that the container closure 1 (top panel wall 7) is deformed excessively and the cap jumps off the mouth-and-neck portion 70 of the container.

However, when the above slits 20 and the internal pressure release line A are formed, the lower portions of slits 20 (recessed portions 19*a* of knurling 19) are pulled in the step of wrap-seaming of FIG. 4, the low-strength bridging portions 50*a* among the slits 20 are broken, and the sealing becomes defective. That is, in the step of wrap-seaming, the thread-forming region 15 in the skirt wall 9 is deformed by using the thread-forming roller 79 along the thread 75 of the mouth-and-neck portion 70 of the container, causing a great deformation to the portions on the lower side of the slits 20 (recessed portions 19*a*) close to the annular groove 17 into which the roller 79 is introduced.

In order to prevent the above inconvenience according to the present invention, an annular bead 30 is arranged neighboring the upper part of the annular groove 17 as shown in FIGS. 1 to 7 (see, particularly, FIG. 5 which is an enlarged view). That is, formation of the annular bead 30 prevents the deformation due to pushing by the roller 19 from transmitted upward despite the wrap-seaming is effected by introducing the thread-forming roller 19 into the annular groove 17 as shown in FIGS. 4 and 5. Therefore, the portion (recessed portion 19*a*) on the lower side of the slits 20 is effectively prevented from being deformed making it possible to effectively suppress the breakage of the low-strength bridging portions 50*a* among the slits 20 caused by the deformation at the time of wrap-seaming.

In the invention described above, the number of slits 20 arranged in the circumferential direction can be formed in a variety of patterns and part of the region therein can be used as the internal pressure release line A.

Figure 8:
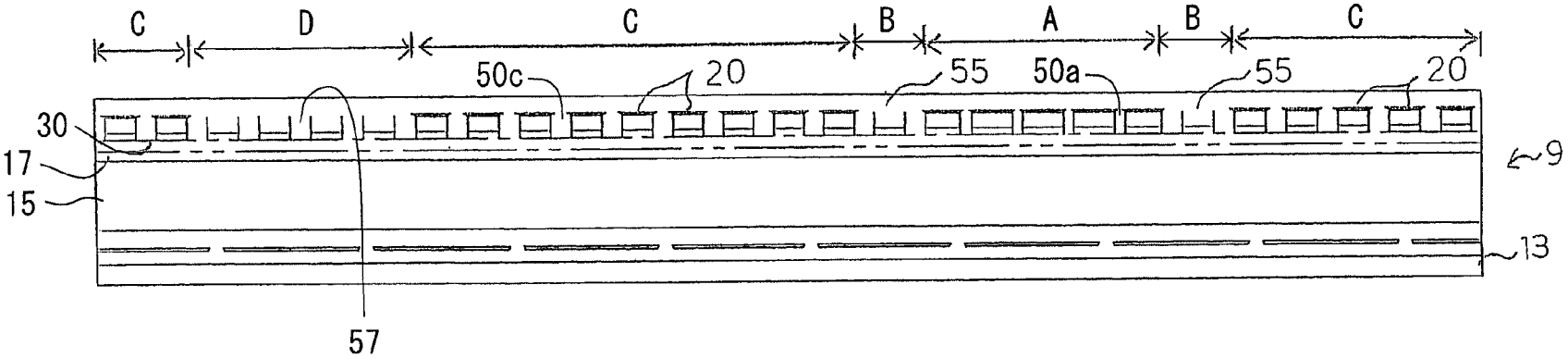
FIG. 8 is an expansion view of a skirt wall illustrating a pattern of slits formed in the skirt wall of the container closure of FIG. 1.

In the example shown in FIG. 1, for example, the internal pressure release line A constituted by low-strength bridging portions 50*a* having a short length among the slits 20 is formed in an arcuate shape. Referring to FIG. 8, on the other hand, the reinforcing line B, internal pressure release assist line C and fixing line D are formed in this order on an extension in the circumferential direction of the internal pressure release line A.

As described already, the internal pressure release line A is a region where the low-strength bridging portions 50*a* are formed having a relatively short length among the plurality of slits 20, and can be easily broken by an increase in the pressure in the container. That is, the low-strength bridging portions 50*a* are readily broken as the top panel wall 7 is deformed by an elevated pressure in the container, and the gas is most easily released. In the internal pressure release line A, it is desired that the low-strength bridging portions 50*a* have a length (distance among the slits 20) which is, usually, in a range of 0.5 to 0.9 mm and, preferably, 0.60 to 0.85 mm. In this region, further, it is desired that the slit 20 has a length in the circumferential direction which is in a range of 2.0 to 5 mm and, particularly, 2.5 to 4.0 mm. When the shell 3 is formed by using a thin metal sheet (e.g., an aluminum base alloy) having a particularly large tensile strength, the internal pressure release line A is formed over an angular range of 40 to 95 degrees from the standpoint of smoothly releasing the gas when the pressure is elevated in the container though it may vary depending upon the material of the shell 3 and the tensile strength.

The internal pressure release assist line C is constituted by intermediate-strength bridging portions 50*c* which are longer than the above low-strength bridging portions 50*a* among the plurality of slits 20. The internal pressure release assist line C is a region that maintains a state where the cap does not jump out so far as the skirt wall 9 is screw-engaged with the mouth-and-neck portion 70 of the container despite the pressure in the container is elevated, and so works that the gas can be easily released in the initial state of cap-opening operation. When the shell 3 is formed by using a thin metal sheet having a particularly high tensile strength, the intermediate-strength bridging portions 50*c* in the region C has a width in the circumferential direction in a range of 1.0 to 3.0 mm and, particularly, 1.2 to 2.5 mm. The slits 20 in the internal pressure release assist line C have a length in the circumferential direction of about 1.5 to about 3.5 mm.

Further, the reinforcing line B formed between the internal pressure release line A and the internal pressure release assist line C is for preventing the low-strength bridging portions 50*a* in the internal pressure release line A from breaking progressively at one time up to the internal pressure release assist line C (intermediate-strength bridging portions 50*c*). No slit 20 is formed in the reinforcing line B. The length of the reinforcing line B in the circumferential direction corresponds to the bridging portion (high-strength bridging portion) 55 between the slit 20 at an end of the internal pressure release line A and the slit 20 at an end of the internal pressure release assist line C, is longer than the intermediate-strength bridging portion 50*c* described above, and is, usually, about 5 to about 25 mm though it may vary depending upon the diameter of the container closure 1 (diameter of the top panel wall 7).

The fixing line D, too, is a region without slit 20 and has a length in the circumferential length which is greater than that of the reinforcing line B (high-strength bridging portion 55), and corresponds to the distance (ultra-high-strength bridging portion) 57 between the slits 20 which are positioned between the ends of the internal pressure release lines C. The fixing line D is the ultra-high-strength region. By suitably forming these regions, it is allowed to adjust the strength making it possible to reliably prevent such an inconvenience that the container closure 1 jumps off the mouth-and-neck portion 70 of the container (cap jumps out) even when the internal pressure is abruptly elevated in the container. The position and the circumferential length of the fixing line D (ultra-high-strength bridging portion 57) may be so set that the gas release function of the internal pressure release line A is not impaired when the pressure is elevated in the container. Usually, it is desired that the fixing line D is positioned on the opposite side in the direction of diameter of the top panel wall 7 with respect, for example, to the internal pressure release line A from the standpoint of balance between the gas release function and the strength. The length thereof in the circumferential direction may differ depending upon the material of the shell 3 and the tensile strength and is not particularly limited, but is in a range of 25 to 180 degrees and, particularly, 40 to 90 degrees when the shell 3 is formed by using a thin metal sheet of a particularly high tensile strength.

In the present invention, the slits 20 forming the internal pressure release line A can be arranged in a variety of patterns.

In a pattern of FIG. 8 employed for the container closure of FIG. 1, for example, the slits 20 are arranged in the circumferential direction so as to form various regions in the following pattern.

B-A-B-C-D-C (A: internal pressure release line, B: reinforcing line, C: internal pressure release assist line, D: fixing line)

Figure 9:
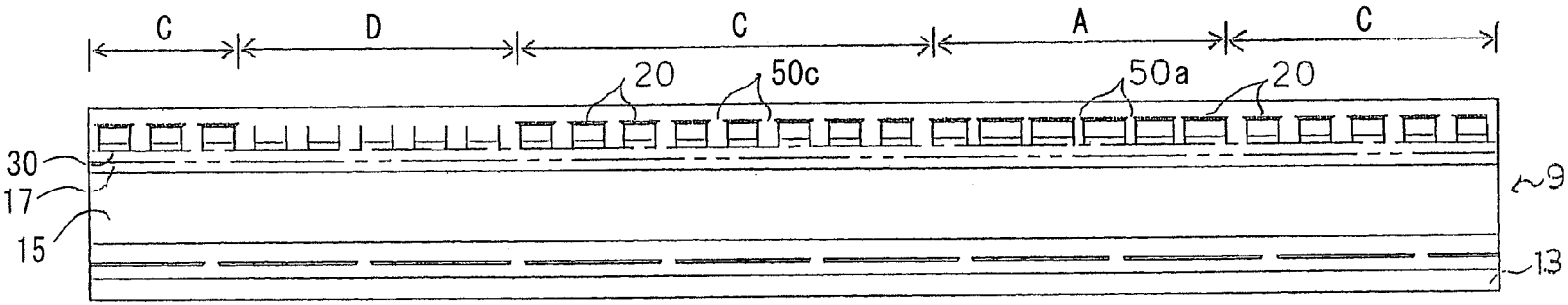
FIG. 9 is an expansion view of a skirt wall illustrating another pattern of slits formed in the skirt wall of the container closure of the present invention.

The above pattern is a representative example, as a matter of course, and the following pattern may be employed as shown, for example, in FIG. 9 without forming the reinforcing line B.

A-C-D-C

In the present invention, further, the plurality of slits 20 forming the above-mentioned internal pressure release line A and the internal pressure release assist line C may all have the same length in the circumferential direction.

In the above example, further, the internal pressure release line A is formed by a plurality of short slits 20 and breakable bridging portions 50*a*. However, the internal pressure release line A can also be formed by using only those slits having a large circumferential length. With the internal pressure release line A formed by using only those slits having a large circumferential length, the gas can be released when the internal pressure is elevated without causing the bridging portions among the slits to be broken. In this case, it is desired that the circumferential length of the long slits is 5 to 35% of the circumferential length of the skirt wall. Further, the slits having a large circumferential length and the internal pressure release assist line C formed by the above-mentioned many short slits 20, may be combined with the above-mentioned reinforcing line B or with the fixing line D. When there is provided the internal pressure release line A formed by the slits having large circumferential length, however, the resistance against drop impact decreases.

In the present invention described above, formation of the annular bead 30 effectively prevents the lower portion of the slits 20 from being deformed at the time of wrap-seaming, making it possible to effectively prevent the breakage of the region where the internal pressure release line A (particularly, low-strength bridging portions 50*a*) is formed at the time of wrap-seaming and, hence, to effectively utilize the gas releasing function of the internal pressure release region A. That is, with the conventional container closure without the annular bead 30, when there are formed bridging portions having a short width among the slits in the circumferential direction, these portions tend to be broken at the time of wrap-seaming.

Therefore, the bridging portions must have an increased width in the circumferential direction to enhance the strength, posing limitation on the gas releasing function when the internal pressure is elevated. The present invention, however, is free from the above limitation.

Upon adjusting the arrangement and size of the regions such as the internal pressure release region A to lie in the above-mentioned predetermined range by arranging the slits 20 in the circumferential direction, further, an excellent gas releasing function can be maintained relying upon the internal pressure release line even when the shell 3 is formed by using a thin metal sheet such as of an aluminum base alloy having a tensile strength in a range of 200 to 230 $N/mm^2$ enhancing the resistance against drop impact and effectively preventing the top panel jumping or the breakage of the container when the pressure in the container is elevated.

In the present invention, further, a weakened line extending in the axial direction can be provided in a region where the internal pressure release line A is formed to further enhance the gas releasing function. FIGS. 10 to 15 illustrate examples of the container closures of when the above weakened line is provided.

Figure 10:
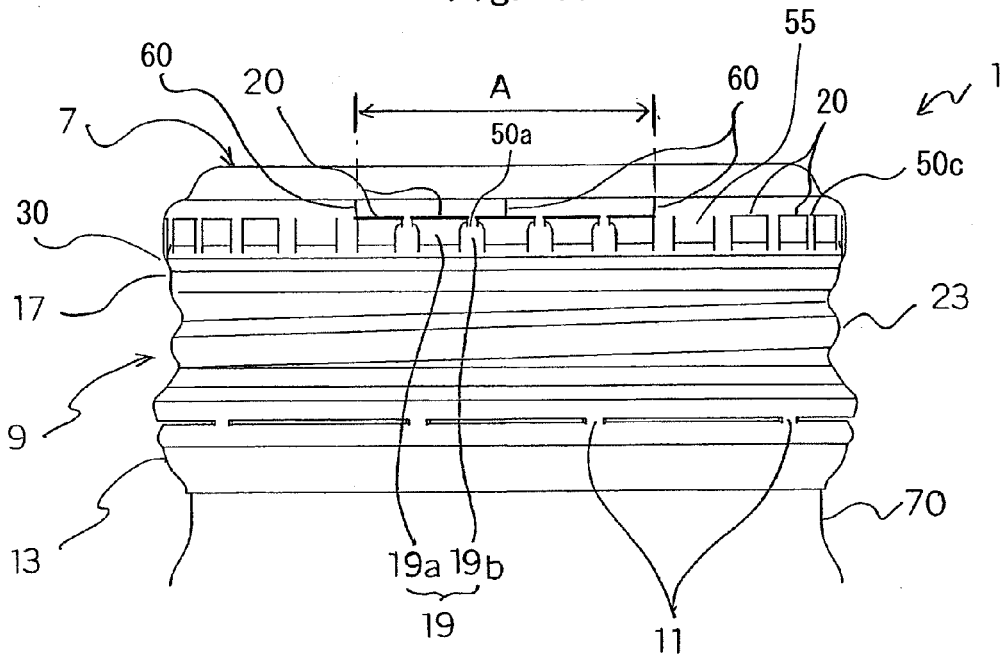
FIG. 10 is a side view illustrating a state where the container closure of FIG. 1 which is of the type having a weakened line in the axial direction formed in the region of internal pressure release line, is wrap-seamed with the mouth-and-neck portion of the container.
Figure 11:
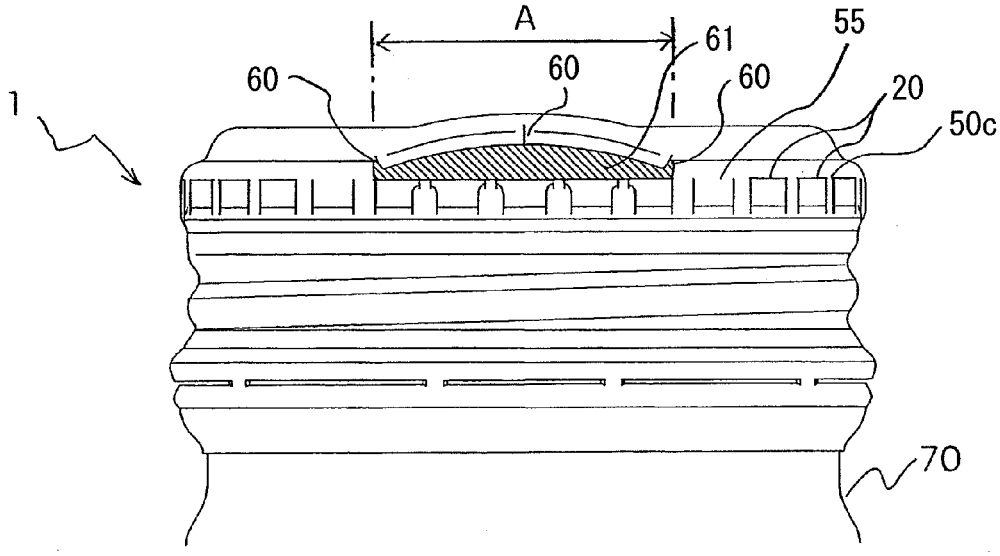
FIG. 11 is a view illustrating a state where the container closure of FIG. 10 is deformed by an elevated internal pressure.

For example, the container closure shown in FIG. 10 has the same structure as the container closure 1 shown in FIG. 6 except that weakened lines 60 extending in the axial direction (i.e., in the vertical direction) are formed at both ends and in the central portion of the internal pressure release line A. The weakened lines 60 may be scores or slits formed in the outer surface side or in the inner surface side of the skirt wall 9, or may be the slits that are formed in a perforated manner. Upon providing the weakened lines 60, stress concentrates in the weakened lines when the pressure in the container is suddenly elevated causing the low-strength bridging portions 50*a* among the slits 20 extending in the circumferential direction to be broken and, at the same time, quickly deforming the skirt wall 9 outward with the weakened lines 60 as fulcrums. As a result, as shown in FIG. 11, a large opening 61 of the shape of a beak is formed in the region where the internal pressure release line A is formed, and the gas is quickly released through the opening 61.

Without the above weakened lines 60, when the pressure in the container is suddenly elevated to a conspicuous degree, the low-strength bridging portions 50*a* break consecutively in the circumferential direction, i.e., the breakage spreads exceeding the internal pressure release line A. Therefore, when the slits 20 are formed over the whole circumference, all of the slits 20 become continuous. As a result, though it rarely happens, the portion over the slits 20 inclusive of the top panel wall 7 of the metallic container closure 1 is separated away from the skirt wall 9 and jumps out. Upon forming the weakened lines 60 on the other hand, the breakage of the low-strength bridging portions 50*a* is confined within the internal pressure release line A owing to the deformation of the skirt wall 9 with the weakened lines 60 as fulcrums. When the pressure in the container is suddenly elevated to a conspicuous degree, therefore, the gas is effectively released while reliably preventing the upper part of the container closure 1 from jumping out.

In the present invention as shown in FIG. 10, it is desired that the weakened lines 60 are continuous to the slits 20 in the internal pressure release line A from the standpoint of deforming the skirt wall 9 with the weakened lines 60 as fulcrums. The weakened lines 60, however, may be formed near the slits 20 so far as there takes place the above deformation. In the above example, further, the weakened lines 60 are arranged on the upper side of the slits 20. However, the weakened lines 60 may be arranged on the lower side of the slits 20 or may be formed on both the upper side and the lower side of the slits 20.

The weakened lines 60 may be formed in a number of only one or in a plural number in the internal pressure release line A. For example, the weakened line 60 may be formed at either one or both of the ends in the circumferential direction of the internal pressure release line A, or may be formed in a number of at least one in a portion between both ends of the internal pressure release line A in the circumferential direction. In the example of FIG. 10, the weakened lines 60 are provided at both ends of the internal pressure release line A in the circumferential direction and, another weakened line 60 is provided in a portion between the two ends of the internal pressure release line A in the circumferential direction.

Figure 12:
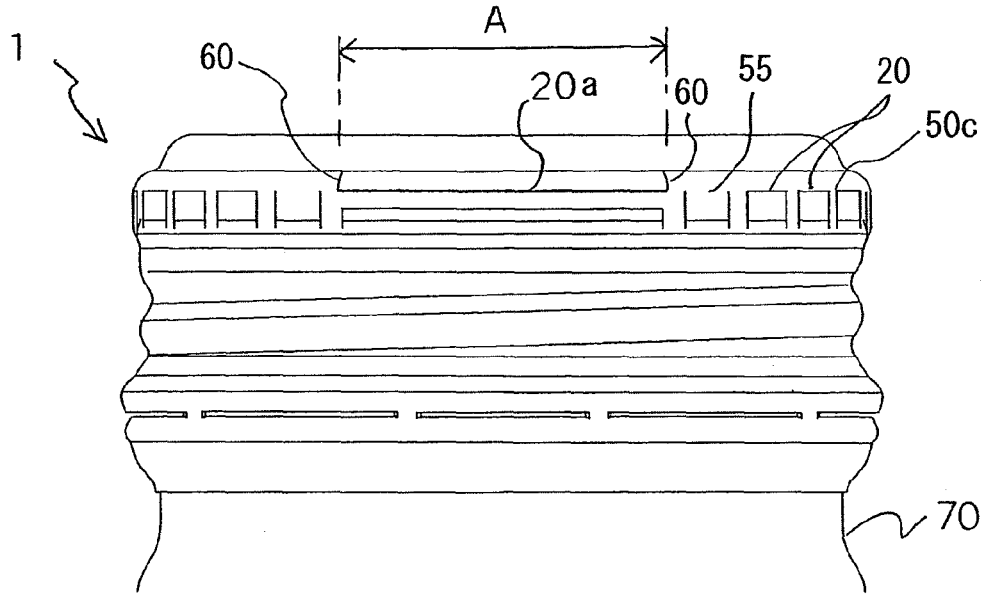
FIG. 12 is a side view illustrating a state where the container closure having-a weakened line in the axial direction formed for an internal pressure release line constituted by a slit in the circumferential direction, is wrap-seamed with the mouth-and-neck portion of the container.
Figure 13:
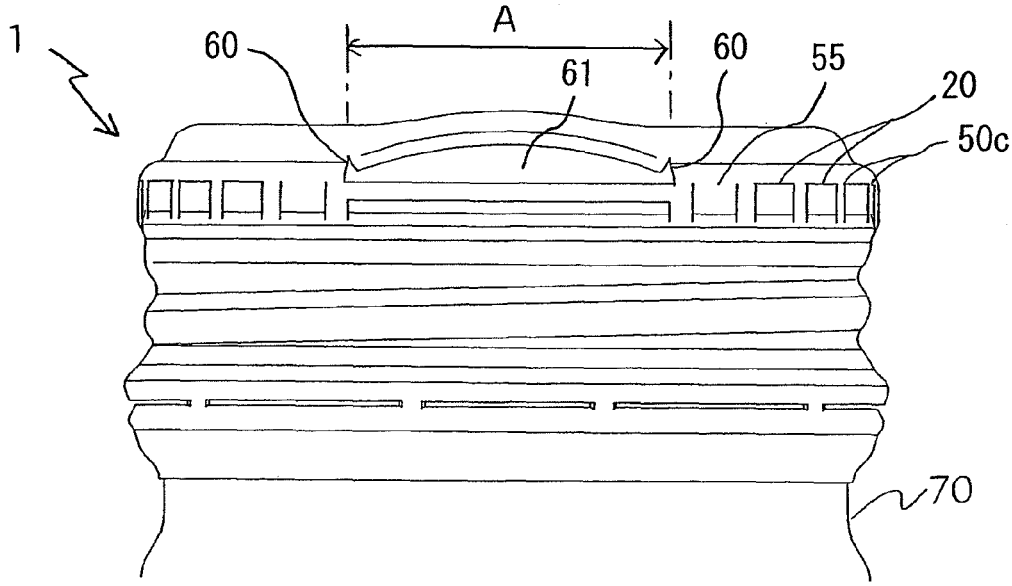
FIG. 13 is a view illustrating a state where the container closure of FIG. 12 is deformed by an elevated internal pressure.

In the example of FIG. 10, further, the internal pressure release line A is constituted by a plurality of slits 20 and low-strength bridging portions 50*a* among them. As shown in FIG. 12, however, the internal pressure release line A may be formed by one slit 20*a* which is elongated in the circumferential direction, and weakened lines 60 described above may be formed at both ends of the slit 20*a*. In this case, too, the skirt wall 9 quickly deforms when the pressure in the container is excessively elevated, and a large opening 61 is formed in the region where the internal pressure release line A (long slit 20*a*) is formed as shown in FIG. 13 to quickly release the gas.

In this case, however, the strength against the drop impact decreases with an increase in the length of the slit 20*a*. It is therefore desired that the internal pressure release line A (slit 20*a*) has a length in a range of 10 to 55 degrees and, particularly, 15 to 40 degrees.

Figure 14:
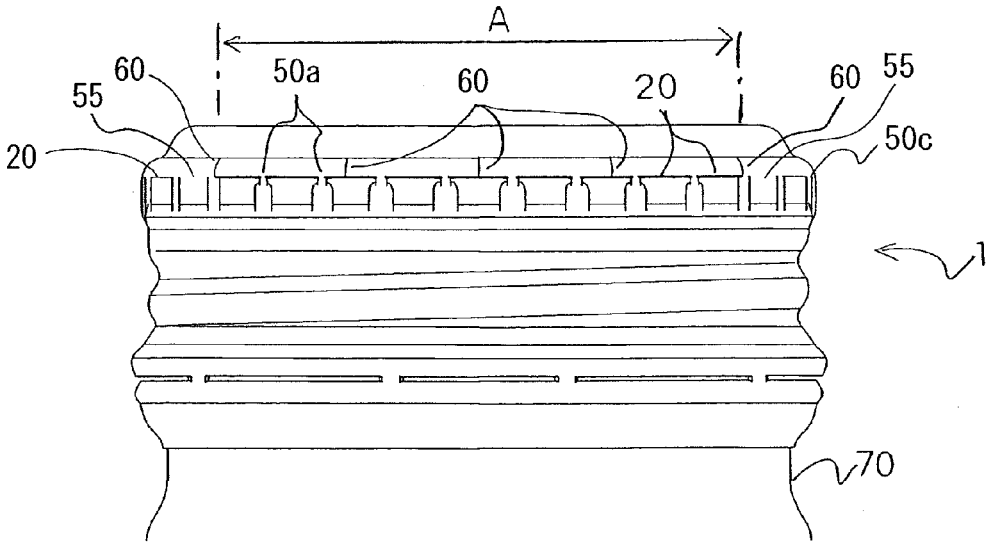
FIG. 14 is a side view illustrating a state where the container closure forming a weakened line in the axial direction in a pattern different from that of FIG. 10, is wrap-seamed with the mouth-and-neck portion of the container.
Figure 15:
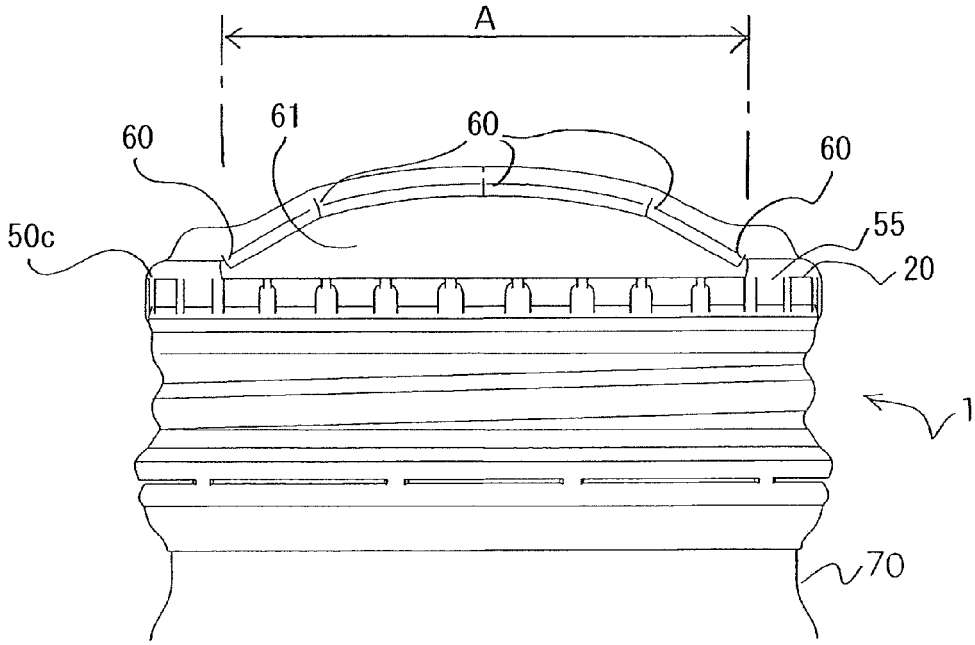
FIG. 15 is a view illustrating a state where the container closure of FIG. 14 is deformed by an elevated internal pressure.

In an example of FIG. 14 like in FIG. 10, the internal pressure release region line A is constituted by a plurality of slits 20 and the low-strength bridging portions 50*a* among them. Here, however, the weakened lines 60 are formed at both ends of the internal pressure release line A, and a plurality of (three) weakened lines 60 are formed in the portions between them. In this case, a very large opening 61 of a shape as shown in FIG. 15 is formed in the internal pressure release line A.

In the present invention, further, the weakened lines aslant in the axial direction may be provided at both ends of the internal pressure release line A to further enhance the gas releasing function. FIGS. 16 to 21 show container closures provided with the weakened lines that are aslant.

In the container closure of FIG. 16, for example, weakened lines (hereinafter called inclined weakened lines) 63, 63 aslant in the axial direction are provided at both ends of the internal pressure release line A instead of forming the weakened lines 60 in the axial direction described above. The aslant weakened lines 63 may be scores, slits or perforations like the weakened lines 60 in the axial direction described above, and their ends may be continuous to the slits 20 positioned at the ends of the internal pressure release line A or may be located near the slits 20.

Figure 17:
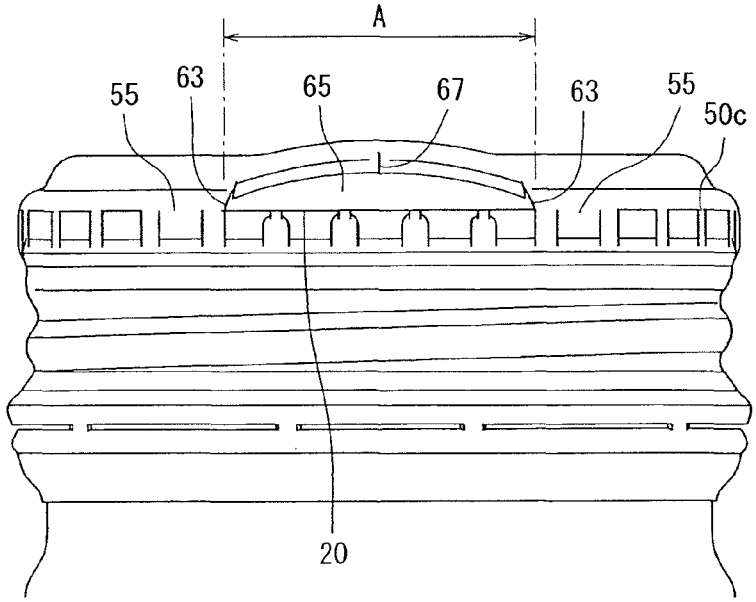
FIG. 17 is a view illustrating a state where the container closure of FIG. 16 wrap-seamed with the mouth-and-neck portion of the container is deformed by an elevated internal pressure.
Figure 18:
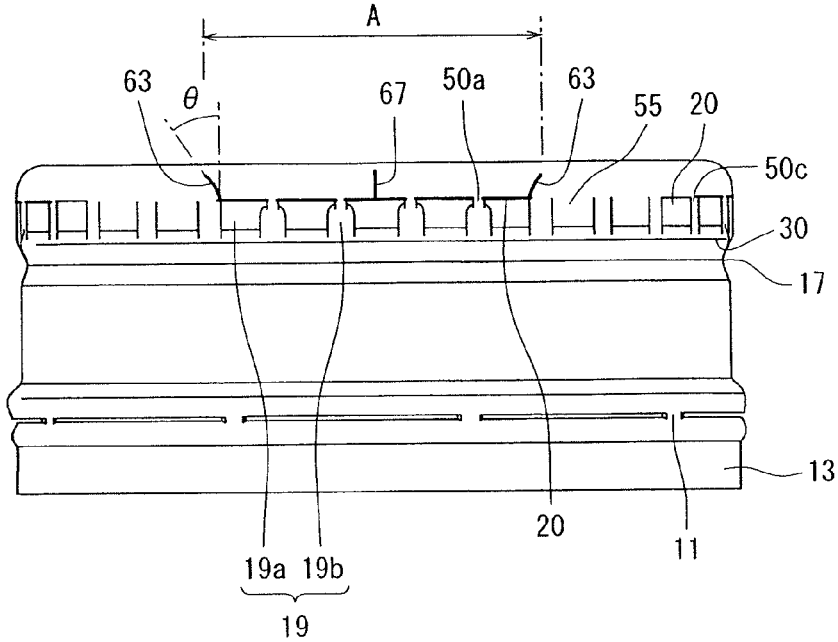
FIG. 18 is a side view illustrating a state where the container closure forming weakened lines aslant with respect to the axial direction in a pattern different from that of FIG. 16, is wrap-seamed with the mouth-and-neck portion of the container.
Figure 19:
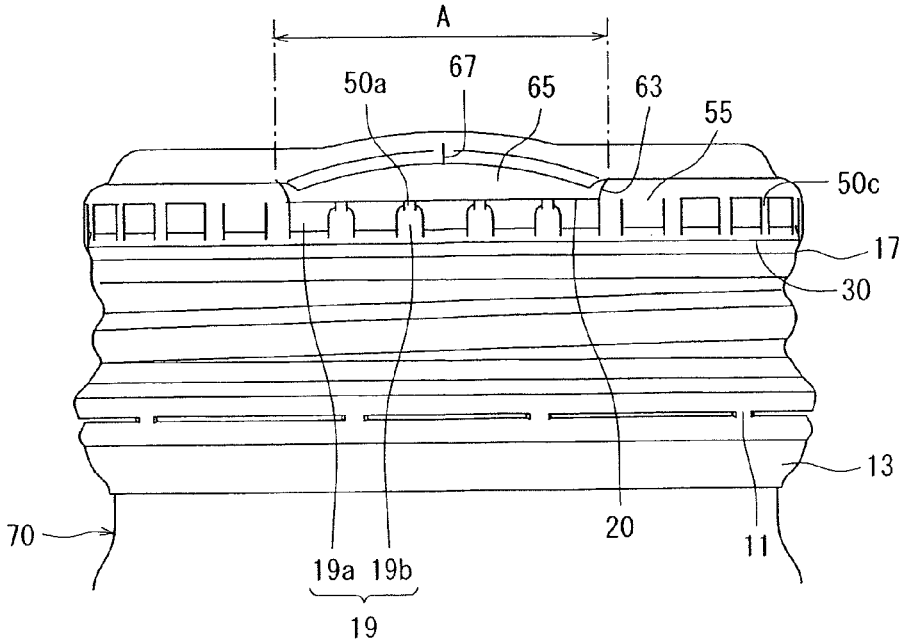
FIG. 19 is a view illustrating a state where the container closure of FIG. 18 wrap-seamed with the mouth-and-neck portion of the container is deformed by an elevated internal pressure.
Figure 20:
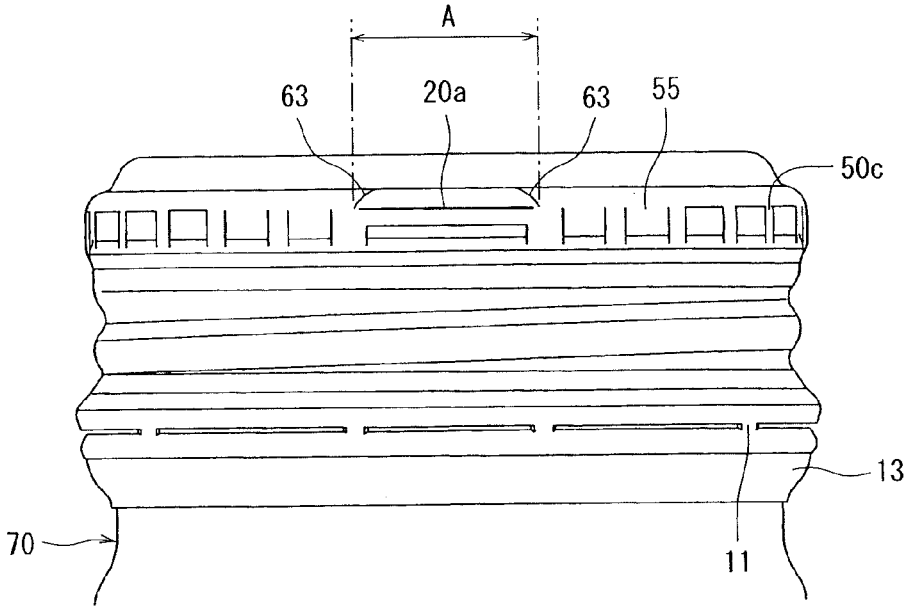
FIG. 20 is a side view illustrating a state of before the container closure having weakened lines formed aslant with respect to the axial direction for an internal pressure release line constituted by a slit in the circumferential direction, is wrap-seamed with the mouth-and-neck portion of the container.

Upon providing the aslant weakened lines 63, too, stress concentrates in the aslant weakened lines 63 when the pressure in the container is suddenly elevated causing the low-strength bridging portions 50*a* among the scores 20 to be broken and, at the same time, quickly deforming the skirt wall 9 outward with the aslant weakened lines 63 as fulcrums. As a result, as shown in FIG. 17, a large opening 65 of the shape of a beak is formed in the internal pressure release region A, effectively preventing the cap and the top panel from jumping out.

Figure 16:
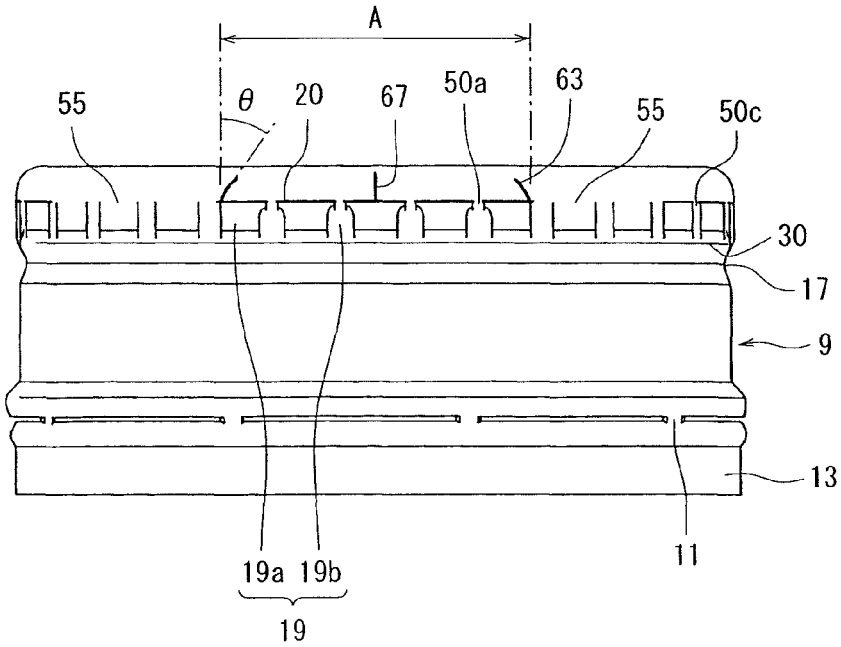
FIG. 16 is a side view illustrating a state where the container closure of FIG. 1 of the type forming weakened lines aslant with respect to the axial direction in the region of the internal pressure release line, is wrap-seamed with the mouth-and-neck portion of the container.

In the example of FIG. 16, further, the pair of aslant weakened lines 63 are provided in a manner to approach each other toward the upper side. Here, it is important that the slanting angle θ is set to lie in a range of 10 to 45 degrees. That is, when the pair of aslant weakened lines 63 are extending at the above slanting angle θ, the breakage that takes place does not spread to the circumferential edge of the top panel wall 7 since the weakening lines are headed toward the central portion away from the circumferential edge of the top panel wall 7 in contrast with the weakened lines 60 extending in the axial direction. Therefore, the top panel jumping is more effectively avoided.

When, for example, the slanting angle θ is smaller than the above range, it may happen that the breakage spreads from the upper ends of the aslant weakened lines 63 to the circumferential edge of the top panel wall 7 in case the pressure in the container is abnormally elevated and the breakage of the aslant weakened lines 63 proceeds at one time. That is, the breakage proceeds along the upper portion of the reinforcing line B (high-strength bridging portions 55), and may reach the intermediate-strength bridging portions 50*c* in the internal pressure release assist line C neighboring the reinforcing lines B, which, therefore, is not still satisfactory from the standpoint of reliably preventing the inconvenience in that the upper part of the container closure 1 inclusive of the top panel wall 7 is separated away from the skirt wall 9 and jumps out. When the slanting angle θ is not smaller than the above range, on the other hand, the aslant weakened lines 30 are not easily broken. As a result, the pressure in the container is strikingly elevated and should the breakage takes place, the top panel wall 7 is broken over the whole circumference and may jump out.

Upon providing the weakened lines 63 which are aslant at a predetermined angle θ as described above, the gas releasing function can be enhanced as compared to when there are provided weakened lines 60 extending in the axial direction, and the top panel jumping can be prevented more reliably.

In the present invention, further, it is desired that the above slanting angle θ is in a range of 10 to 30 degrees. That is, as the slanting angle θ increases, the aslant weakened lines 63 become less likely to be broken by the rise of the pressure in the container. Therefore, as the slanting angle θ approaches 45 degrees, the strength of the low-strength bridging portions 50*a* in the internal pressure release line A must be decreased (width of the low-strength bridging portions 50*a* in the circumferential direction must be decreased) to quicken the breakage of these portions, so that the gas can be reliably released by forming the opening 65 in case the pressure is abnormally elevated in the container. However, if the width of the low-strength bridging portions 50*a* is too shortened, the low-strength bridging portions 50*a* tend to become easily broken at the time of wrap-seaming the container closure 1 with the mouth-and-neck portion 70 of the container. Therefore, the allowable range becomes narrow in the step of wrap-seaming, and precision is required for controlling the wrap-seaming. When the slanting angle θ is considerably smaller than 45 degrees and lies in a range of 10 to 30 degrees, the weakened lines 30 break more easily than when the slanting angle θ is 45 degrees. Therefore, the width of the low-strength bridging portions 50*a* does not need to be so shortened as that of when the slanting angle θ is 45 degrees to decrease the strength. This broadens the allowable range in the step of wrap-seaming, avoids the occurrence of defective products, and is very advantageous for improving the productivity.

In the present invention, further, it is desired to provide at least one weakened line 67 extending in the axial direction for accelerating the deformation between the pair of aslant weakened lines 63 formed at both ends of the internal pressure release line A. Upon forming the weakened line 67, the skirt wall 9 is folded on the weakened line 67 for accelerating the deformation in case the aslant weakened lines 63 are broken at both ends due to a sudden elevation in the pressure in the container, and the skirt wall 9 easily and quickly deforms into a state of being swollen outward, enabling the gas to be released more smoothly and more quickly.

In the example of FIGS. 16 and 17, the pair of aslant weakened lines 63 are extending upward and aslant at a predetermined slanting angle θ. So far as the slanting angle θ lies in the above-mentioned range, however, the aslant weakened lines 63 may extend aslant in a direction in which they separate away from each other toward the upper side as shown in a side view of FIG. 18 and in FIG. 19 which illustrate a deformed state due to an elevated internal pressure. In such a case, too, a large opening 65 of the shape of a beak is formed in the internal pressure release line A due to the breakage of the aslant weakened lines 63 or of the low-strength bridging portions 50*a* caused by an abnormally elevated pressure in the container, and the gas is quickly released through the opening 65 (see FIG. 19). From the standpoint of preventing the top panel jumping, however, it is desired that the pair of weakened lines are extending at a predetermined slanting angle θ in a direction in which they approach each other from the lower side toward the upper side. In this case, even when the breakage of the aslant weakened lines 63 expands and spreads on the extensions thereof, the breakage is in a direction to separate away from the internal pressure release assist line B. The breakage does not proceed along the upper end portion of the high-strong region B, and the top panel jumping is prevented more reliably.

Figure 21:
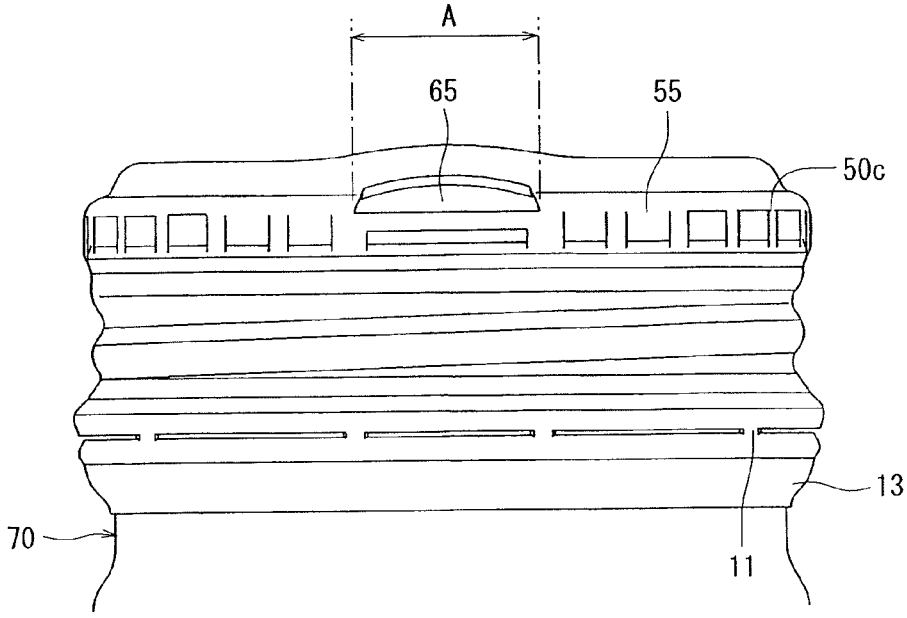
FIG. 21 is a view illustrating a state where the container closure of FIG. 21 wrap-seamed with the mouth-and-neck portion of the container is deformed by an elevated internal pressure.

In the present invention, the pair of aslant weakened lines 63 can be provided at both ends of the internal pressure release line A formed by a long slit 20*a* which is extending in the circumferential direction like the case of the weakened lines 60 in the axial direction described above. In this case, too, the aslant weakened lines 63 extending at a predetermined slanting angle (extending in this example in a direction in which they approach each other toward the upper side) break due to an abnormally elevated pressure in the container, whereby the slit 20*a* is greatly torn forming a large opening 65 in the shape of a beak in the internal pressure release line A as shown in FIG. 21 and enabling the gas to be quickly released through the opening 65.

EXAMPLES

Excellent effects of the invention will now be described by way of experiments.

Experiment 1

A shell of a form shown in FIG. 1 having a nominal diameter of 38 mm was formed by using a thin aluminum base alloy sheet of a thickness of 0.25 mm (tensile strength of 215 $N/mm^2$). Next, a soft polyethylene which was softened and molten was fed onto the top panel wall of the shell, and a liner of a shape shown in FIG. 1 was press-formed to thereby form a container closure of a form having an annular bead as shown in FIG. 1. The container closure possessed the following specifications.

Outer diameter of liner: 36.3 mm

Circumferential length of slit 20: 3 mm

Number of slits 20: 21

Pattern of the lines constituted by slits 20 and bridging portions among them:

B-A-B-C-D-C (pattern of FIG. 8)

Whole circumferential length of the internal pressure release line A: 65 degrees Low-strength bridging portions 50*a:*

Circumferential width: 0.70 mm (tensile strength 60 N)

Number: 2

Intermediate-strength bridging portions 50*c:*

Circumferential width: 1.4 mm

Reinforcing lines B (high-strength bridging portions 55):

Circumferential width: 5 mm

Number: 2

Circumferential width of fixing line D (ultra-high-strength bridging portion 57): 20 mm There were provided containers made of a thin aluminum sheet having a volume of 310 ml and a mouth-and-neck portion of a nominal diameter of 38 mm (outer diameter of the outer curling was 33.5 mm) placed in the market from Mitsubishi Material Co., and the above container closures were wrap-seamed with the mouth-and-neck portions of the containers as shown in FIG. 4. Fifty container closures were wrap-seamed in quite the same manner, but no breakage was at all recognized in the bridging portions among the slits 20.

Experiment 2

Container closures were produced in the same manner as in Experiment 1 but changing the specifications of the low-strength bridging portions 50*a* in the internal pressure release line A of the container closures as described below, and the wrap-seam testing was conducted in the same manner.

Low-strength bridging portions 50*a:*

Circumferential width: 0.73 mm (tensile strength 65 N)

Number: 2

As a result of wrap-seam testing, no breakage was recognized in the bridging portions among the slits 20 in all of fifty container closures.

Experiment 3

Comparative Example

Container closures were produced in the same manner as in Experiment 1 but without forming the annular bead, and the wrap-seam testing was conducted in the same manner.

The pattern of arrangement of the slits 20 and the bridging portions among them was quite the same as that of Experiment 1, and, for example, the low-strength bridging portions 50*a* were as follows:

Low-strength bridging portions 50*a:*

Circumferential width: 0.7 mm (tensile strength 60 N)

Number: 2

As a result of wrap-seam testing, breakage was recognized in the low-strength bridging portions 50*a* among the slits of four container closures out of fifty container closures.

Experiment 4

Comparative Example

Container closures were produced in the same manner as in Experiment 1 but without forming the annular bead, and changing the specifications of the low-strength bridging portions 50*a* forming the internal pressure release line A of the container closure as described below, and the wrap-seam testing was conducted in the same manner.

Low-strength bridging portions 50*a:*

Circumferential width: 0.75 mm (tensile strength 70 N)

Number: 2

As a result of wrap-seam testing, breakage was recognized in the low-strength bridging portions 50*a* among the slits 20 of one container closure out of fifty container closures.

It will be learned from the above results that formation of the annular bead makes it possible to effectively prevent the breakage at the time of wrap-seaming even for the bridging portions have a small distance among the slits 20.

That is, when the annular bead is formed as in the present invention, it is allowed to form low-strength bridging portions having a short distance among the slits 20, enabling the gas to be effectively released even when the pressure is elevated little in the container. With the container closure of Experiment 2, for example, the low-strength bridging portions 50*a* were broken when the internal pressure was 0.86 MPa, and the gas was released.

With the container closure of Experiment 4 without forming the annular bead, on the other hand, the bridging portions were broken for the first time when the internal pressure was elevated to 0.97 MPa, and the gas was released.

In the following Experiments, the strengths of the low-strength bridging portions 50*a* in the internal pressure release line A were measured as described below and were shown as vent bridge strengths (VB strengths).

Method of Measuring the Vent Bridge Strengths:

Test pieces of a rectangular shape including two low-strength bridging portions 50*a* of the inner side out of four low-strength bridging portions 50*a* present in the internal pressure release line A were cut out by using a pair of scissors from the aluminum container closures produced in the above Experiments of before being wrap-seamed. Next, in a state where the lower part of the test piece was fixed by using a fixing jig, the upper part of the test piece was pulled up to measure the breaking strength of the vent bridges in the axial direction by using a measuring instrument (push-pull gauge).

Experiments 5 to 8

Container closures that can be wrap-seamed with threaded metal cans having a mouth of a diameter of 38 mm were produced by using an aluminum sheet of a thickness of 0.25 mm and a tensile strength of 215 N manufactured by Sumitomo Light Metal Co.

The container closures that were produced possessed a structure as shown in an expansion plan of FIG. 8 and, further, possessed aslant weakened lines 63 extending aslant with respect to the axial direction at both ends of the internal pressure release line A as shown in FIG. 16.

The aslant weakened lines 63 were so formed as to approach each other toward the upper side by using such scores that left a thickness of 100 μm in the skirt wall 9. The aslant angles θ were selected to be 10 degrees, 20 degrees, 30 degrees and 0 degree as shown in Table 1. The samples were produced in a number of 10 for each Experiment.

The lines A to D that were formed possessed the following specifications.

Internal pressure release line A:

Circumferential length: 21 mm

Number of low-strength bridging portions 50*a*: 4

Strength of vent bridges of low-strength

Bridging portions 50*a*: about 60 N of a total of two (width of about 0.60 mm per each bridge)

Width of internal pressure release assist lines C: 15 mm each

The aluminum container closures that were produced were treated according to the procedure described below to prepare test samples.

(1) A threaded metal can (volume of 339 ml) made of aluminum manufactured by Mitsubishi Material Co. was filled with hot water of 87±2° C., and liquid nitrogen was added thereto dropwise to remove the air in the head space, followed by capping.

(2) The capped container was thrown down sideways for 30 seconds and was, thereafter, erected upright.

(3) The container returned to the erected state was cooled by the shower of water heated at 76° C. for 3 minutes, 50° C. for 5 minutes, 40° C. for 5 minutes and 35° C. for 5 minutes in this order.

(4) The container closure was opened by hand and, thereafter, the cap was closed to the wrap-seamed position as in the initial state.

(5) A needle connected to a nitrogen feeding device was penetrated through the body wall of the container in a test room at 23° C., and nitrogen was supplied into the container at a rate of 0.034 MPa/s to elevate the pressure in the container.

(6) The pressure was measured in the container with which the internal pressure release region was deformed and the internal pressure was released.

At this moment, not only the number of deformations of the internal pressure release regions A but also the number of breakage of the container closures and the number of top panel walls that jumped, were counted.

The results were as shown in Table 1.

Experiment 9

Test samples were produced in quite the same manner as in Experiment 5 but selecting the slanting angle θ to be 45 degrees and changing the vent bridge strength of a total of two low-strength bridging portions 50*a* to be about 55 N, and were put to the experiment. The results were as shown in Table 1.

TABLE 1

| | Experiment 5 | | Experiment 6 | | Experiment 7 θ | | Experiment 8 | | Experiment 9 | |
|---|---|---|---|---|---|---|---|---|---|---|
| | 10° | | 20° | | 30° | | 0° | | 45° | |
| No. | Vent pressure | Jumping | Vent pressure | Jumping | Vent pressure | Jumping | Vent pressure | Jumping | Vent pressure | Jumping |
| 1 | 0.80 | no | 0.76 | no | 0.85 | no | 0.82 | no | 0.71 | no |
| 2 | 0.79 | no | 0.75 | no | 0.88 | no | 0.81 | yes | 0.72 | no |
| 3 | 0.81 | no | 0.83 | no | 0.81 | no | 0.76 | no | 0.72 | no |
| 4 | 0.79 | no | 0.74 | no | 0.82 | no | 0.81 | no | 0.74 | no |
| 5 | 0.81 | no | 0.77 | no | 0.79 | no | 0.82 | no | 0.74 | no |
| 6 | 0.83 | no | 0.79 | no | 0.86 | no | 0.67 | no | 0.72 | no |
| 7 | 0.83 | no | 0.85 | no | 0.85 | no | 0.79 | no | 0.72 | no |
| 8 | 0.81 | no | 0.82 | no | 0.85 | no | 0.81 | no | 0.74 | no |
| 9 | 0.83 | no | 0.81 | no | 0.81 | no | 0.81 | no | 0.73 | no |
| 10 | 0.82 | no | 0.77 | no | 0.85 | no | 0.74 | no | 0.69 | no |
| Ave. | 0.812 | *0/10 | 0.789 | *0/10 | 0.837 | *0/10 | 0.784 | *1/10 | 0.723 | *0/10 |
| Max. | 0.83 | | 0.85 | | 0.88 | | 0.82 | | 0.74 | |
| Min. | 0.79 | | 0.74 | | 0.79 | | 0.67 | | 0.69 | |

Vent pressure is a pressure of when the internal pressure is released and is expressed in MPa.
*means jumping occurrences number.

Experiment 10

Container closures of the following specifications having lines A to D in a pattern as shown in FIG. 8 were produced in the same manner as in Experiment 1 by using the same thin aluminum base sheet as that of Experiment 1.

Outer diameter of liner: 37.0 mm

Internal pressure release line A:

Whole circumferential length: 66.7 degrees

Circumferential length of the slit 20: 3.1 mm

Circumferential length of the low-strength bridging portion 50*a*: 0.73 mm

Number of the low-strength bridging portions 50*a*: 4

Reinforcing line B:

Circumferential length: 20 degrees each

Internal pressure release assist line C:

Circumferential length of the slit 20: 3.1 mm

Circumferential length of the intermediate-strength bridging portion 50*c*: 1.4 mm Number of the intermediate-strength bridging portions 50*c*: 14

Fixing line D:

Whole circumferential length: rest

There were provided containers made of a thin aluminum sheet having a volume of 310 ml and a mouth-and-neck portion of a nominal diameter of 38 mm (outer diameter of the outer curling was 33.5 mm) placed in the market from Mitsubishi Material Co. Each container was filled with 300 ml of hot water of 85° C., and liquid nitrogen was added thereto dropwise so that the pressure in the container was 0.13±0.05 MPa, and the above container closure was wrap-seamed with the mouth-and-neck portion of the container as shown in FIG. 4 to obtain a sample A.

Ten samples A were subjected to the compression test according to the procedure described below. The container closure was, first, removed by hand from the mouth-and-neck portion and was screw-fixed again to the mouth-and-neck portion. Next, a needle having a gas-charging hole was penetrated through the end of the top panel wall of the shell, and the sample was submerged in the water vessel. The nitrogen gas was charged at a rate of a pressure increase of 0.034 MPa/sec. to measure the internal pressure with which the pressure in the container was released. A maximum value was 0.93 MPa, a minimum value was 0.82 MPa and an average value was 0.88 MPa. The container closure mounted on the container from which the internal pressure had been released was observed to find that the low-strength bridging portions constituting the internal pressure release line of the shell had been broken and that the top panel wall of the shell and the liner arranged in the inner surface thereof had been deformed.

Further, ten samples were subjected to the 30-cm drop impact test according to the procedure described below. First, the pressure in the container was measured through the body wall of the container by using the "Non-Destructive Pressure-in-the-Can Measuring Instrument" placed in the market from Daiwa Seikan Co. Next, the container in an inverted state was allowed to freely fall 30 cm vertically through a falling passage, and the portion of the low-strength region constituting the internal pressure release line was allowed to come into collision with a steel cylindrical member of which the upper surface was aslant by 10 degrees. After left to stand 24 hours (a whole day), the pressure in the container was measured by using the above "Non-Destructive Pressure-in-the-Can Measuring Instrument" to find that there was no decrease in the internal pressure (i.e., no leakage has occurred).

What we claim is:

1. A metallic container closure shell prior to thread formation having a circular top panel wall and a cylindrical skirt wall hanging down from a circumferential edge of the top panel wall, and a synthetic resin liner arranged in the shell, the skirt wall of the shell having a thread-forming region and an annular groove positioned at an upper end portion of the thread-forming region, wherein:

an internal pressure release line inclusive of a slit extending in the circumferential direction is arranged in the skirt wall at a portion over the annular groove, and an annular bead is arranged so as to pass through between the internal pressure release line and the annular groove;

wherein the annular bead extends in the horizontal direction, and wherein a knurling is formed over the annular groove of the skirt wall and the internal pressure release line is formed at the upper end of the knurling.

2. A metallic container closure shell according to claim 1, wherein the internal pressure release line is constituted by a plurality of slits arranged in the circumferential direction maintaining a distance, and a low-strength bridging portion present among the slits and having a small width in the circumferential direction so as to be broken by an elevated pressure in a container.

3. A metallic container closure shell according to claim 2, wherein the internal pressure release line is formed over an angular range of 40 to 95 degrees.

4. A metallic container closure shell according to claim 3, wherein the low-strength bridging portion in the internal pressure release line has a width of 0.5 to 0.9 mm in the circumferential direction, and the slit in the internal pressure release line has a length of 2.5 to 4.0 mm in the circumferential direction.

5. A metallic container closure shell according to claim 3, wherein the internal pressure release line includes 4 to 6 low-strength bridging portions.

6. A metallic container closure shell according to claim 1, wherein the internal pressure release line is formed by one long slit extending in the circumferential direction.

7. A metallic container closure shell according to claim 6, wherein the internal pressure release line is constituted by the long slit having a length 5 to 35% of the circumferential length of the skirt wall.

8. A metallic container closure shell according to claim 7, wherein the internal pressure release line includes slits having a short circumferential length in addition to the long slit.

9. A metallic container closure shell according to claim 1, wherein an internal pressure release assist line is formed on an extension in the circumferential direction of the internal pressure release line, the internal pressure release assist line being constituted by a plurality of slits extending in the circumferential direction and a high-strength bridging portion which is positioned among the slits and has a width in the circumferential direction larger than that of a low-strength bridging portion.

10. A metallic container closure shell according to claim 9, wherein the plurality of slits forming the internal pressure release line and the internal pressure release assist line all have substantially the same width in the circumferential direction.

11. A metallic container closure shell according to claim 1, wherein at least one weakened line extending in an axial direction is formed in a region where the internal pressure release line is formed.

12. A metallic container closure shell according to claim 11, wherein the weakened line is extending being continuous to the slit forming the internal pressure release line or from near the slits.

13. A metallic container closure shell according to claim 11, wherein the weakened line is positioned over the slit.

14. A metallic container closure shell according to claim 11, wherein the weakened line is a score.

15. A metallic container closure shell according to claim 11, wherein the weakened line is formed in a portion either at an end of the internal pressure release line in the circumferential direction or at an intermediate portion thereof in the circumferential direction.

16. A metallic container closure shell according to claim 15, wherein the pair of weakened lines are extending upward in the axial direction being continuous to the slit or from near the slit.

17. A metallic container closure shell according to claim 1, wherein a pair of weakened lines extending aslant with respect to an axial direction are formed at both ends of the internal pressure release line in the circumferential direction, the pair of weakened lines extending in a direction in which they approach each other or separate away from each other from the lower side toward the upper side at slanting angles $\theta$ in a range of 10 to 45 degrees with respect to the axial direction.

18. A metallic container closure shell according to claim 17, wherein the pair of weakened lines are extending in a direction in which they approach each other from the lower side toward the upper side.

19. A metallic container closure formed from the metallic container closure shell of claim 1.

* * * * *